US005860516A

United States Patent [19]

Geppert

[11] Patent Number: 5,860,516

[45] Date of Patent: Jan. 19, 1999

[54] ELECTRIC SWITCH ASSEMBLY

[75] Inventor: Michael Geppert, Ingelheim, Germany

[73] Assignee: Eaton Controls GmbH & Co KG, Langenlonsheim, Germany

[21] Appl. No.: 817,635

[22] PCT Filed: Oct. 26, 1995

[86] PCT No.: PCT/DE95/01510

§ 371 Date: Jul. 28, 1997

§ 102(e) Date: Jul. 28, 1997

[87] PCT Pub. No.: WO96/14648

PCT Pub. Date: May 17, 1996

[30] Foreign Application Priority Data

Nov. 2, 1994 [DE] Germany ..... 44 39 008.4

[51] Int. Cl.[6] ..... H01H 21/22; H01H 23/16; H01H 23/26

[52] U.S. Cl. ..... 200/553; 200/557; 200/558; 200/315

[58] Field of Search ..... 200/431–439, 200/453–461, 6 R, 6 B, 6 BA, 6 BB, 408, 457, 529, 520–528, 530–536, 553–562, 315

[56] References Cited

U.S. PATENT DOCUMENTS

| | | | |
|---|---|---|---|
| 3,708,776 | 1/1973 | Ellenberger | 337/66 |
| 3,828,151 | 8/1974 | Bunnell et al. | 200/459 |
| 4,447,687 | 5/1984 | Marquardt et al. | 200/533 |
| 4,640,998 | 2/1987 | Sorenson | 200/457 |
| 4,751,352 | 6/1988 | Botz et al. | 200/6 BB |
| 4,916,269 | 4/1990 | Spazierer et al. | 200/408 |
| 5,558,211 | 9/1996 | Heydner et al. | 200/553 |
| 5,651,452 | 7/1997 | Schaeffeler et al. | 200/437 |

FOREIGN PATENT DOCUMENTS

| | | | |
|---|---|---|---|
| 1329035 | 12/1963 | France . | |
| 2148804 | 1/1973 | Germany | H01H 13/54 |
| GM 71 38 974 | 7/1979 | Germany . | |
| 3421021 | 12/1985 | Germany | H01H 23/20 |
| 91-10485 | 10/1991 | Germany | H01H 23/26 |

*Primary Examiner*—J. R. Scott
*Attorney, Agent, or Firm*—Roger A. Johnston

[57] ABSTRACT

An electric restoring switch is provided with a button (13) that allows actuation about an eccentric axle (14) and has attached to it at least one link (16) transferring the actuation, and is provided with a contact spring (17) that is arranged in a housing (1) supporting connectors (10) and featuring a notched contact tongue (18). To arrive at a switch that manages without complex parts, allows easy assembly, offers a reliable switching feel and, besides, is small in its structure, the link (16) of the button (13) acts on a switching member (20) which is aligned approximately parallel to the direction of actuation (19) of the button (13), is assembled elastically and is pivotable, the pivot (21) of the switching member (20) being situated away from the axle (14) of the button (13), and the switching member (20) carrying a cam (22) that acts on the contact tongue (18) of the contact (17) fitted parallel to the direction of actuation (19) of the button (13).

9 Claims, 5 Drawing Sheets

ELECTRIC SWITCH ASSEMBLY

BACKGROUND OF THE INVENTION

The invention relates to an electric restoring switch comprised of a button that allows actuation about an eccentric axle and carries at least one link that transfers the actuation, and of a contact spring which is arranged in a housing supporting electric connectors and features a notched contact tongue.

Known from DE-GM 71 38 974 is an electric restoring switch in which a bearing for the pivot axle of the button is arranged eccentrically and above a contact rail. The button features a link that acts on an elastic contact tongue of a contact spring, which contact tongue is notched out of the elastic contact spring. The contact spring is arranged approximately perpendicularly to the button in the housing. It has only one fixed bearing about which it pivots under the effect of the link contained on the button, as the button is actuated. The contact tongue is responsible for the position of the button and for the necessary contact force. This configuration necessitates a large-area design of the housing bottom and that the contact spring has a complex shape, so as to assure resetting as well as the contact force. Heat buildup due to the flow of current through the contact spring, however, will cause the spring force to diminish and the superficial forward resistance to increase, leading to a temperature buildup.

Furthermore, DE 34 21 021 C2 discloses an electric restoring switch with a button to which two links are molded symmetrically, between which a cam is fitted which alternately plunges in two depressions of a contact spring, thereby causing the contact spring to pivot to its opposite position. The two links are elastic and shaped, on their sides facing the cam, in such a way that the cam returns upon completed actuation again to its zero position. This configuration of the link and of the cam is relatively expensive and requires great accuracy in their manufacture. The recoil of the cam depends on the spring properties of the plastic material, and thus on its fatigue strength[1].

[1] Translator: "Halterungsbedtändigkeit" [durability as a holding device] appears to be a typographic error; proper term is presumably "Alterungsbest ändigkeit" [fatigue strength]

SUMMARY OF THE INVENTION

The objective underlying the invention is to provide a switch of the initially cited type that manages without complex parts, allows easy assembly, offers a dependable switching feel and, besides, is small in its structure.

This objective is met according to the invention in that the link of the button acts on a switching member which is aligned approximately parallel to the direction of actuation of the button, is assembled elastically and is pivotable, the pivot of the switching member being situated away from the axle of the button, and the switching member carrying a cam that acts on the contact tongue of the contact spring, which is assembled parallel to the direction of actuation of the button.

Resulting from this measure is a reduction in parts attached to the button, an improved switching feel, since it depends no longer on the spring properties of the contact spring, which is acted upon electrically, and a size reduction of the switch, since the large-area contact spring is fitted in the housing parallel to the direction of actuation of the switch.

According to one embodiment of the invention, a projection with a support cone is provided on a cover assembled to the housing, on which cone the button bears by means of a kerf recessed in it, and to the side webs of the button extending in the direction of the axle there are clip hooks molded that pivot with the button in arcuate fashion and engage behind shoulders that are molded to the cover and extend in correspondingly arcuate fashion. Hence, the button allows selective assembly, depending on the sequence of assembly. The button can be fitted as the last component in the completely assembled switch and is thus protected from damage. It is thus possible to fit the button in the cover prior to closing the switch, in order to facilitate production line a fluent configuration.

The button assembly in the completely preassembled switch, respectively joining the cover carrying the button to the housing, is according to the invention facilitated also in that at least one of two links molded to the button possesses on its end away from the button a V-shaped kerf, from the apex of which a slot for receiving a switching member driver is recessed in the link in the direction of the button.

The components are preferably molded integrally to one part, so as to preclude assembly tolerances, and the position of the components relative to one another define the sequence of assembly, thereby precluding erroneous assembly. A base is preferably fitted in the housing that carries the electrical conductors extending to the contact points, the base featuring a fixing device that aligns the contact spring, and a switching member mount receiving the switching member, both arranged in the direction toward the interior of the switch.

The holding device consists of two abutments, one being arranged on the end of the base away from the button, and the other on the end of the base near the button, at the transition to the cover; and, the abutment faces on which the contact spring bears are aligned approximately parallel to the button's direction of actuation. This arrangement allows an easy design definition of the switching point, since no additional angles need to be allowed for, and the contact spring always bears flat. It will be recognized that ease of component assembly has a favorable effect on price and reduces the frequency of assembly errors. Therefore, the abutment away from the button features preferably an assembly bevel that rises above the abutment face and carries a locating boss on which the contact spring is placed with its locating hole. Thus, the contact spring is always positioned by the locating boss and the assembly bevel. To further restrict a tilting of the contact spring, the abutment on the near side of the button possesses a wall rising above the abutment face, with the contact spring bearing with one edge on the side of the said wall.

According to a further preferred embodiment of the invention, the switching member mount consists of a two-part rocker bearing disposed away from the button and a locking web, near the button, that is molded to the wall in the direction of the rocker bearing. Said rocker bearing features a V-shaped pivot seat, and the locking web has a gate type recess, the alignment of the two relative to each other being such that the tip of the V-shaped pivot seat points away from the button; a pivot seat in the gate type recess points toward the button, with a reset bevel coordinated with the pivot seat and aligned toward it. A reduction in components is achieved and, thus, a corresponding reduction in cost. The elements of the switching member mount are also molded to the abutments, resulting in a simplification of the tooling structure. The actuating force of the button can be influenced by modification of the reset bevel. The reset force of the button changes then accordingly.

To allow preassembly of the housing and the switching member to assume always the same position in which the button enters in operating connection with it, the switching member is given a three-point suspension with a dependable seat that is protected against displacement. The spring-loaded locking element, in conjunction with the reset bevel, respectively the snap seat, always the same position. The switching member comprises a cylinder that receives a spring-loaded snap element interacting with the gate type recess, which cylinder features a driver that engages the slot in the link and whose end near the button features a groove for receiving the locking strip, the cam acting on the contact tongue of the contact spring is arranged on the periphery of the cylinder in the direction of the base, and on the end of the cylinder, away from the button, there is a two-part rocker ridge arranged which engages the two-part rocker bearing on the switching member mounts.

A rugged design of the contact spring is obtained by giving it a continuous outer shape. Such shape is obtained easily in the strip, with little scrap accruing, and the pre-alignment can be reconciled very easily with the rolling direction of the strip. Therefore, according to a further embodiment, the approximately rectangular contact spring is on its end away from the button adapted, on one corner, to a bevel adapted to the assembly bevel of the holding device, and the other corner contains the locating hole receiving the boss of the holding device. Situated in the interior of the contact spring is the contact tongue, whose blanking edge of a web near the button, created in notching, bears on the side face of the wall of the holding device. The contact tongue of the contact spring is preferably attached to the contact spring by way of a narrow web, on the side away from the button, and the cam arranged on the switching member acts on this web, pushing the contact spring, in the inoperative position of the button, on the abutments, with a U-spring attached with its base to the web, whose contact shanks pointing toward the button carry spring contacts on their ends. This arrangement allows adapting the contact tongue to the requirements with appropriate ease, which is accomplished by a thickness variation of the web. The cam of the switching element pushes on the contact tongue and holds the contact spring in the nonoperative position on the abutments, thereby assuring the existence of an always identical spacing. Lastly, the contact tongue can be adapted to the current flowing through it, by modification of the U-spring cross section.

Naturally, it is possible to integrate the electric restoring switch in other components, in which case the function of the electric restoring switch can be utilize for the relevant component in which it is installed. According to one embodiment of the invention, therefore, the electric restoring switch is part of an automotive interior light, where the housing, the cover and the base are part of the automotive interior light, and the cover features a translucent area and an opaque area with a hole through which the button extends.

DETAILED DESCRIPTION

Figure 1:
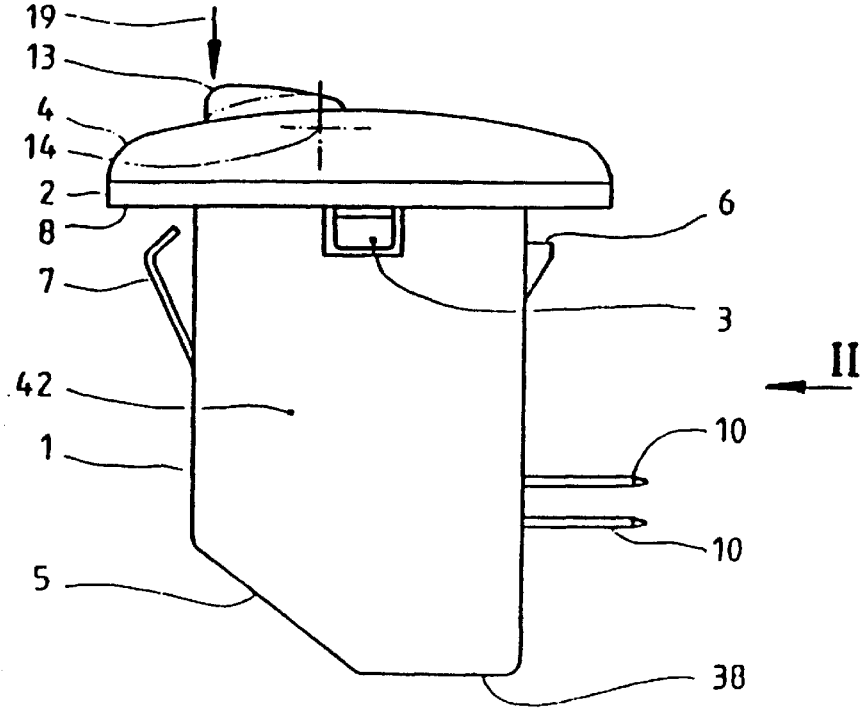
FIG. 1, a side elevation of an electric restoring switch according to the invention.
Figure 2:
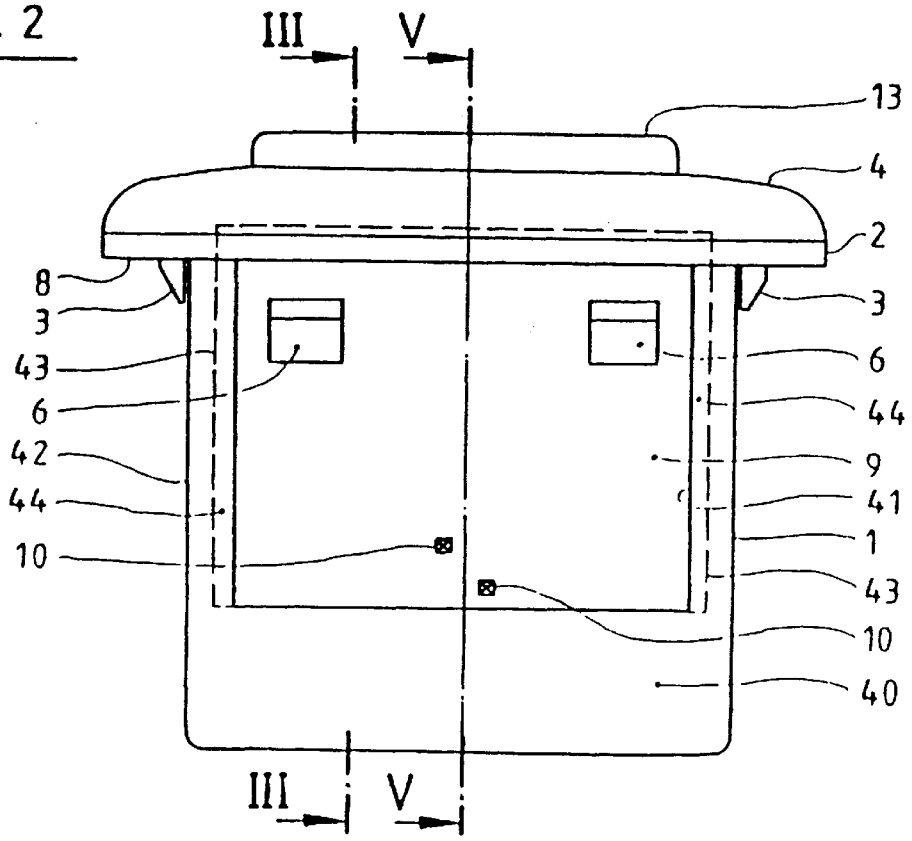
FIG. 2, a view of the electric restoring switch in the direction of arrow II according to FIG. 1.
Figure 3:
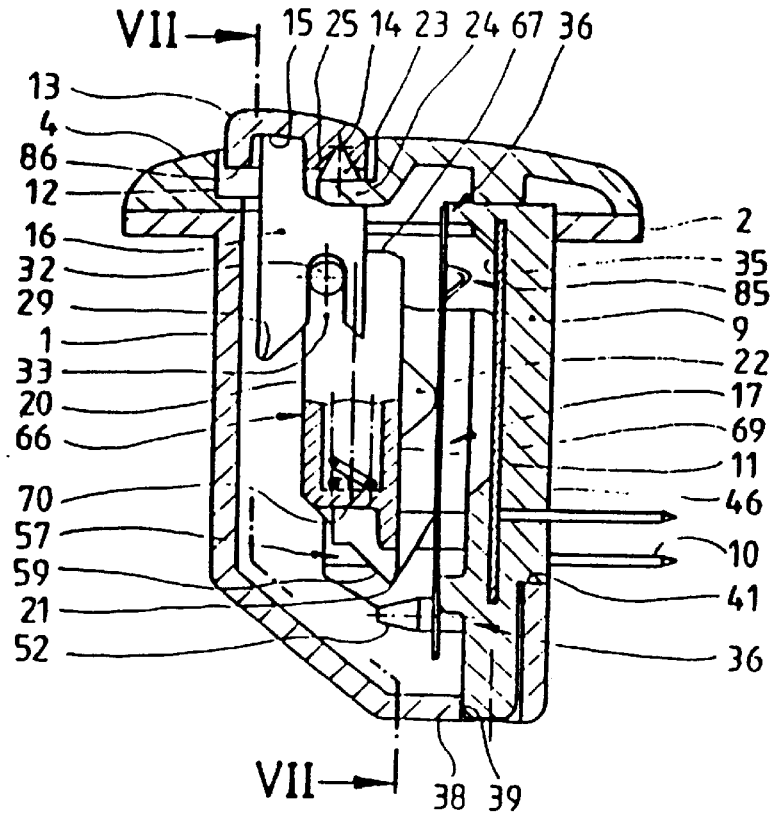
FIG. 3, a section through the electric restoring switch relative to FIG. 2, along line III—III, in unactuated state.
Figure 4:
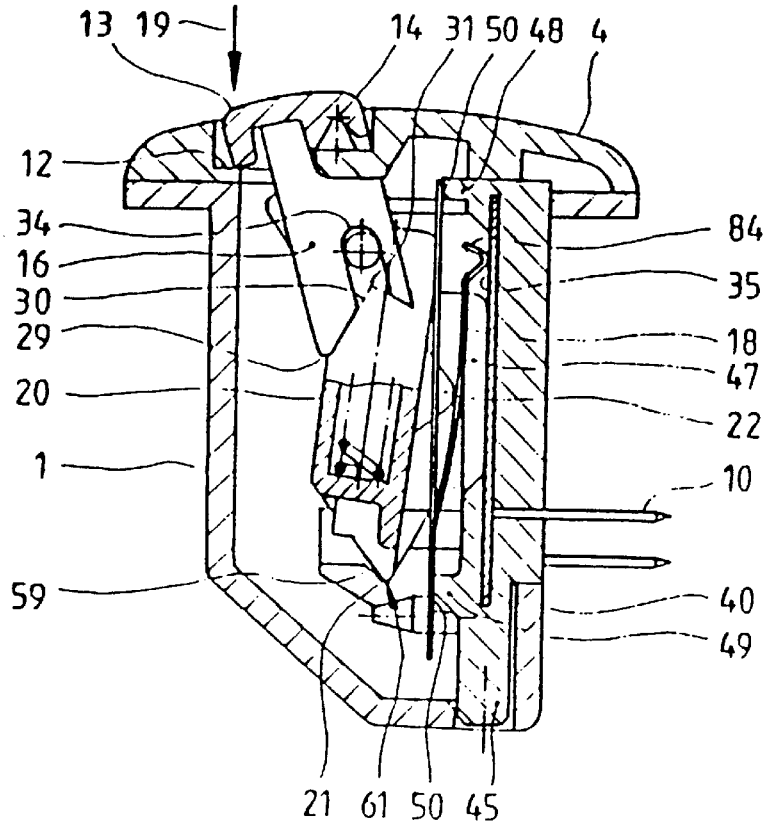
FIG. 4, a section through the electric restoring switch according to FIG. 3, in actuated state.
Figure 5:
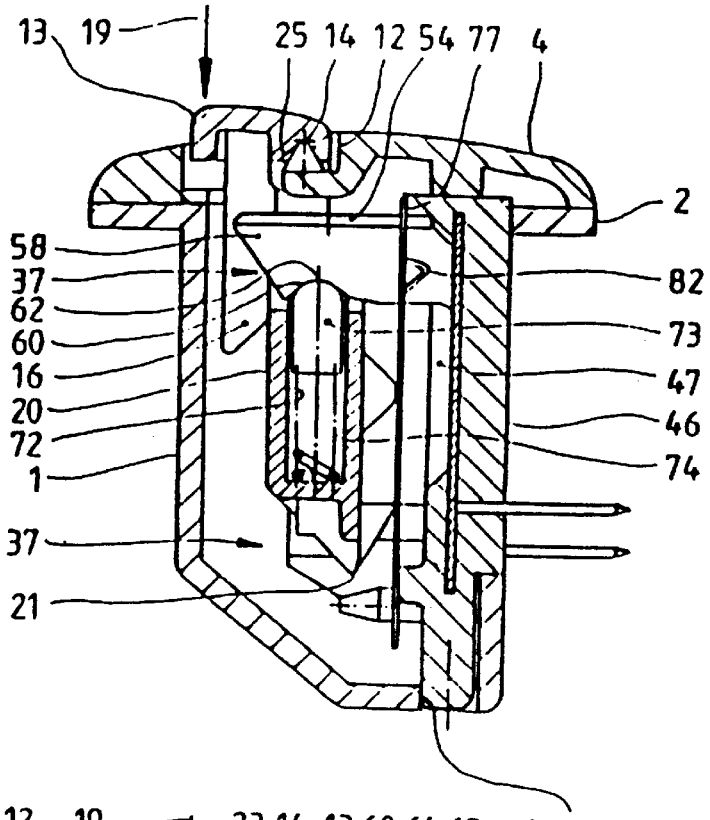
FIG. 5, a section through the electric restoring switch according to FIG. 2, along line V—V in unactuated state.

The electric restoring switch consists essentially of a rectangular housing 1 which at its top has a surrounding rim 2, to which a cover 4 is attached by means of clips 3. On its end away from rim 2, the housing has a bevel 5 which allows tilting the electric restoring switch into an assembly opening and locking it in place in it by means of seat 6 and snap spring 7. Underside 8 of rim 2 bears then on the top side of the assembly opening.

Fixed in housing 1 is a base 9 which on its outside, which is flush with the housing 1, has a snap seat 6. Connector pins 10, which inside the base 9 have an electrically conducting connection to blanked strips 11 that are molded in, protrude out of base 9. On its side away from the housing, cover 4 has a hole 12 through which protrudes a button 13. In FIG. 1, said button 13 is indicated by solid lines in unactuated state, while the dash-dot line indicates its actuated state. Button 13 pivots about an eccentric axle 14 and, with it, simultaneous, links 16 attached to inside 15 of button 13. Links 16 of button 13 protrude into housing 1, acting there on a switching member 20, which is elastically mounted, aligned approximately parallel to the direction of actuation 19 of button 13, and pivots about pivoting point 21 of switching member 20, which is situated away from axle 14 of button 13. Cam 22 on switching member 20 acts on a contact tongue 18 notched off a contract spring 17. Said contact spring 17 is fitted in housing 1 approximately parallel to the direction of actuation 19 of button 13.

Molded to cover 4 are two projections 24 that protrude into the area of cover hole 12 and support on their ends an upward-pointing support cone 23. Said support cone 23 is not centered in the cover hole 12. Also, its tip is beneath the surface of cover 4. The intersection between the center axis of support cone 23 and its tip is the axle 14 about which the button 3 pivots. Recessed in button 3, from its underside, is a notch 25 with which button 13 sits on support cone 23. Clip hooks 27 are molded to the side webs 26 of button 13, situated in the direction of axle 14. Said clip hooks 27 pivot with button 13 in arcuate fashion about axle 14. Molded to cover 4 are shoulders 28 for the clips, which extend in corresponding arcuate fashion around axle 14. Clip hooks 27 provided on button 13 latch over the shoulders 28 on cover 4, fixing button 13 while allowing it to pivot eccentrically.

V-shaped kerfs 30 are recessed in the links 16 molded to the button 13, on their ends 29 away from button 13. A slot 33 extends from apex 31 of the V-shaped kerf 30 in the direction of button 13. The slot 33 in the link 16 houses a driver 32 of the switching member 20. The depth of slot 33 is such that the driver 32 will in none of the pivotal positions of button 13 and switching member 20 come to bear on the slot bottom 34.

Base 9 supporting the connector pins 10 is fitted in the housing 1. The connectors extend via stamped conductors 11 to the contact points 35 that are exposed inside the switch. The housing possesses for attachment of base 9, for one, a through hole 39 in the housing bottom 38 and, for another, a jog 41 in the housing wall 40 and, furthermore, a groove 43 each in opposing narrow sides 42 of the housing. Base 9 is assembled to housing 1 from its open end, which in assembled state is closed off by cover 4. One base spring 44 each engages the housing groove 43. Base key 45 engages locating hole 39 in the housing bottom 38, and the base bottom 46 is flush with the housing wall 40, providing a continuous outside wall for the electric restoring switch. The stamped conductors are molded into the base 9. Said base 9 has in its interior a recess 47 where the conductors 11 emerge. In this area, conductors 11 form the contacts points 35. Furthermore, base 9 has in its interior a holding device 36 that aligns the contact spring 17 and a mount 37 into which the switching member 20 is sprung. The holding device 36 molded to base 9 consists of two abutments 48, 49. Abutment 48 is located on the end of base 9 near button 13, at the transition to cover 4. Abutment 49 is located on the end of base 9 away from button 13. Each abutment 48, 49 has a face 50 on which bears contact spring 17. Abutment faces 50 are at the same level as base 9 and aligned approximately parallel to the direction of actuation 19 of button 13. Abutment 49, away from button 13, features, for one, an assembly bevel 51 for the contact spring 17 that rises beyond abutment face 50 and, for another, a locating boss 52 on which contact spring 17 is fitted with its locating hole 53. Abutment 48, near the button 13, possesses a wall 54 that rises above the abutment 50. Bearing on a side face 55 of the wall with a blank edge 56 is the contact spring 17. Hence, contact spring 17 is guided by locating boss 52, side face 55 of wall 54, and assembly bevel 51.

Fastened to base 9, the switching member mount 37 consists, for one, of a rocker bearing 57 and, for another, of a snap bracket 58. Rocker bearing 57 is split in two parts and contained on base 9, away from button 13. Said bearing is symmetric in structure 10 and possesses one each V-shaped pivot seat 59 located outside the width of contact spring 17. Snap bracket 58, near the button 13, is molded to wall 54 and points toward the two-part rocker bearing 57. Carved into snap bracket 58 is a recess 60 with a seat 62. The arrangement of pivot seat 59 in the switching member mount 37 is such that tip 61 of the V-shaped pivot seat 59 points away from button 13, whereas the seat 62 in recess 60 points toward button 13. A reset bevel 63 is molded to the snap bracket 58, between seat 62, in the direction of base 9; the working direction of reset bevel 63 is aligned toward seat 62. Contained in the reset bevel 63 of recess 60, furthermore, is an action point 64 that enables a more tactile switching.

Figure 6:
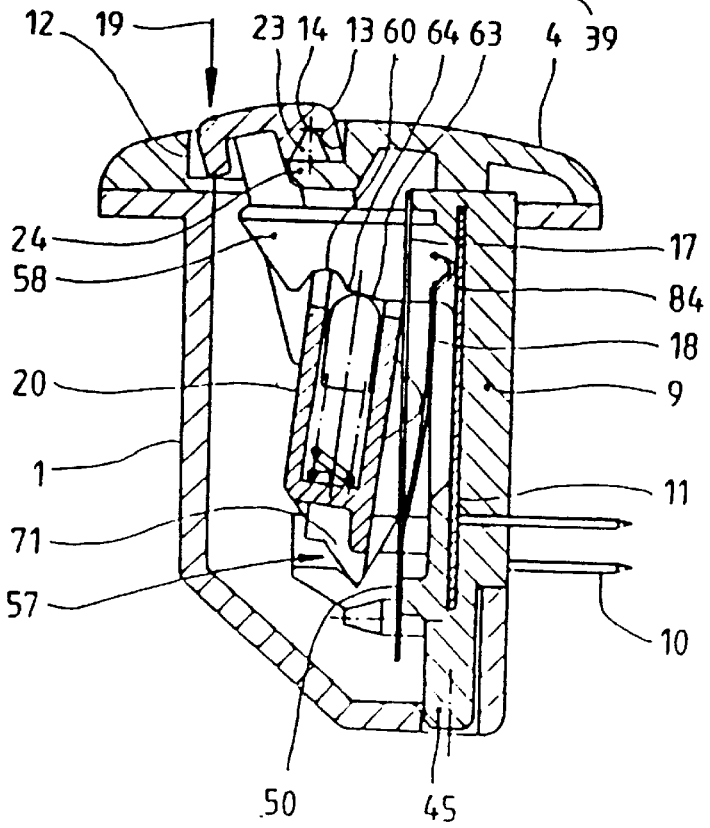
FIG. 6, a section through the electric restoring switch according to FIG. 5, in actuated state.
Figure 7:
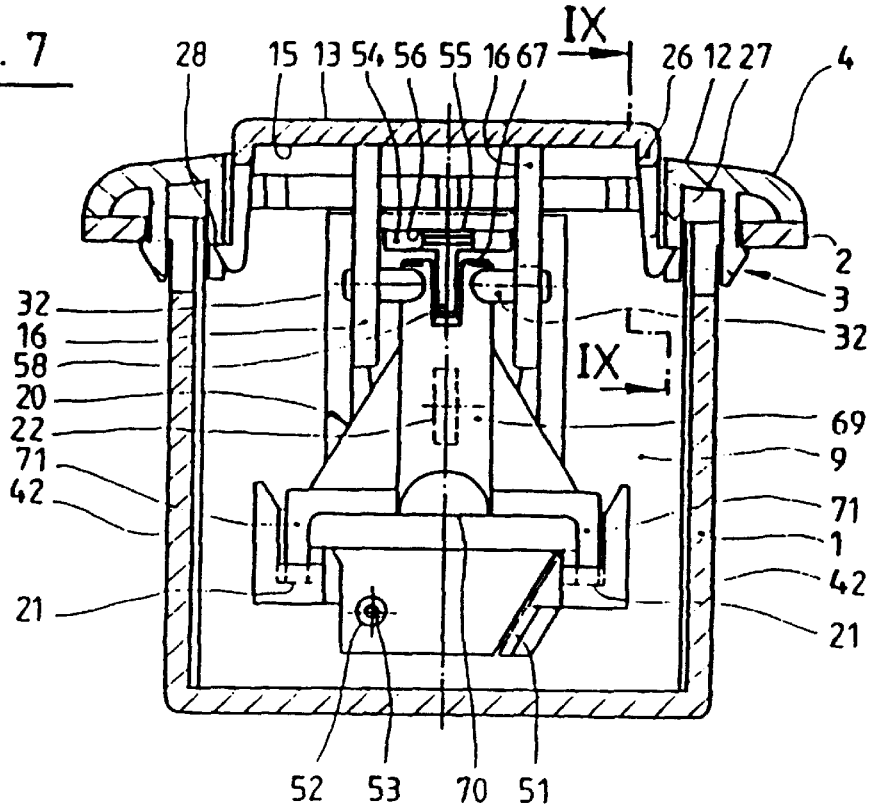
FIG. 7, a section through the electric restoring switch according to FIG. 3, along line VII—VII.
Figure 8:
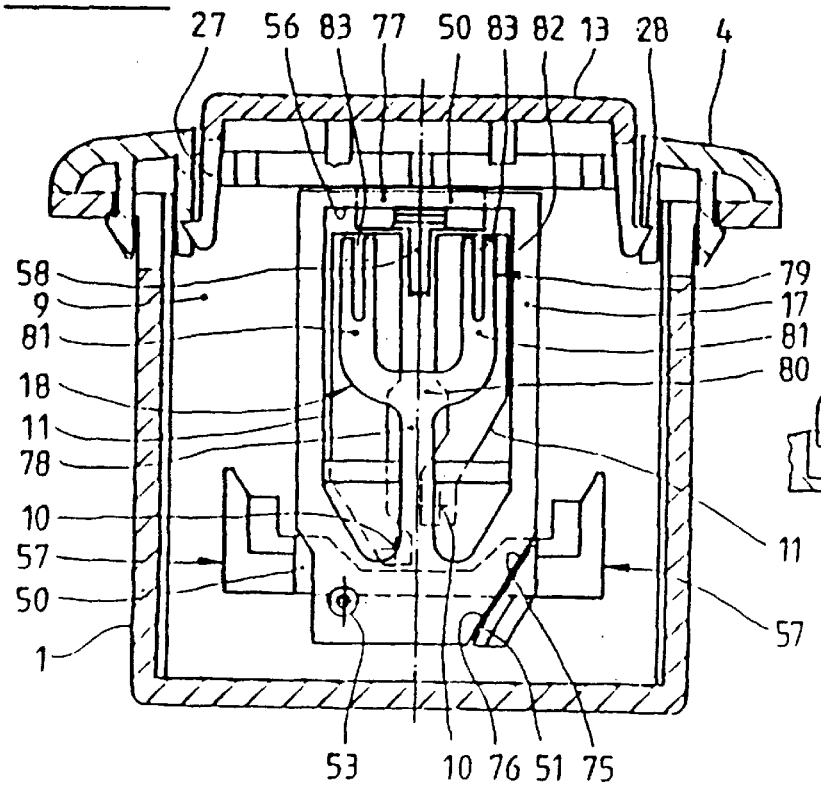
FIG. 8, the illustration according to FIG. 7 without built-in switching member.
Figure 9:
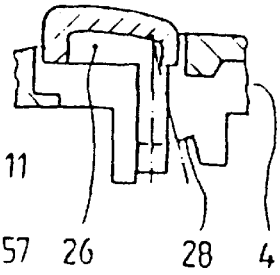
FIG. 9, a partial section through the illustration relative to FIG. 7, along line IX—IX.

Switching member 20 consists of a cylinder 66 centered between rocker bearings 57 and, thus, centered relative to recess 60, as a central element. Located at the periphery 69 of cylinder 66 are two drivers 32 that engage the slot 33 in the links 16. Recessed in end 67 of cylinder 66 on the near side of button 13 is a groove 68 which receives the snap bracket 58 of the switching member mount 37, allowing it to slide. Recessed from the same side of end 67, into cylinder 66, is a blind hole 72 in which snap element indicated generally at 65 is fitted. It consists of a pusher sleeve or plunger 73 receiving the end of compression spring 74, while the other end of compression spring 74 bears on the bottom of blind hole 72. Fastened to the periphery 69 of cylinder 66 is cam 22, which is aligned in the direction of base 9. Cam 22 acts on tongue 18 of contact spring 17. Split in two, the rocker ridge 71 (see FIG. 6) is contained on the butt end 70 of cylinder 66 away from button 13. The rocker ridge is V-shaped with an angle more acute than that of rocker bearing 57. With said rocker ridge 71, the switching element 20 is fitted in the rocker bearing 57. Plunger 73 rests in is unactuated position on seat 62, thus keeping the switching member 20 approximately parallel to the direction of actuation 19 of button 13.

Contact spring 17 contained in holding device 36, in base 9, possesses an approximately rectangular shape. A corner 75 is provided, on its end away from button 13, with a bevel 76 that matches bevel 51 of the holding device 36. The locating hole 53 is contained in the other corner 76 of the contact spring 17. Said hole 53 is engaged by locating boss 52 of the holding device 36. The contact tongue 18 contained inside the contact spring 17 is made integral with it by notching. Said notching has in the outer area as well again an approximately rectangular shape. It creates a web 77 facing the button 13. Inner edge 56 of said web 77 bears on the side face of wall 54 of the holding device 36. The notched contact tongue 18 is fixed on contact spring 17, integral with it, by a narrow web 78; the latter is contained on the side of contact spring 17 away from button 13. Contained on cylinder 66 of the switching element 20, the cam 22 acts on said narrow web 78. In the rest position of the electric restoring switch, the contact spring 17 is pushed already on abutments 48, 49. A U-shaped spring 79 is fastened with its base 80 to the narrow web 78, with slots 83 splitting the contact shanks 81 in twin contacts that point toward button 13 and feature on their ends the spring contact points 82. The latter are realized by an angle 84 formed on contact tongue 78. The tip 82 of the contact angle 84 is rounded for creating a flawless contact with the contact points 35.

The following addresses the functional sequences, illustrated in FIG. 3 through 6. Pushed in the direction of actuation 19, button 13 pivots about axle 14 until its underside 86 hits the bottom 76 of cover hole 12, which limits the travel of button 13. As it pivots, button 13 entrains links 16, causing them to entrain drivers 32 of switching member 20, which drivers are fitted in their slots 33. Switching member 20 pivots about pivot 21, snap element 65 separates from its seat 62 and slips against the force of compression spring 74 down the reset bevel 63. As soon as pusher sleeve 73 reaches action point 64, the force to be applied in the direction of actuation 19 increases, conveying to the user a reliably discernible or detectable switching action point. Simultaneously with the pivoting of switching member 20, cam 22 pushes the contact tongue 18 in the direction of contact points 35. Spring contact points 82 of contact tongue 18 reach the contact points 35 already before completion of the pivotal swing of the switching member. The additional overshoot improves the dependable contact-making, causing the spring contact points 82 to slide on the contact points 35 with the result of a self-cleaning of the contacts. Once button 13 is released, switching element 20 pushes the pusher sleeve 73 under the effect of compression spring 74 of snap element 65 along the reset bevel 63, until said pusher sleeve catches within bracket seat 62. Owing to its spring properties, elastic contact tongue 18 has separated by itself from the contact points 35 and returned to its neutral position. Simultaneously with the switching element 20, button 13 was reset via drivers 32 and links 16.

Figure 10:
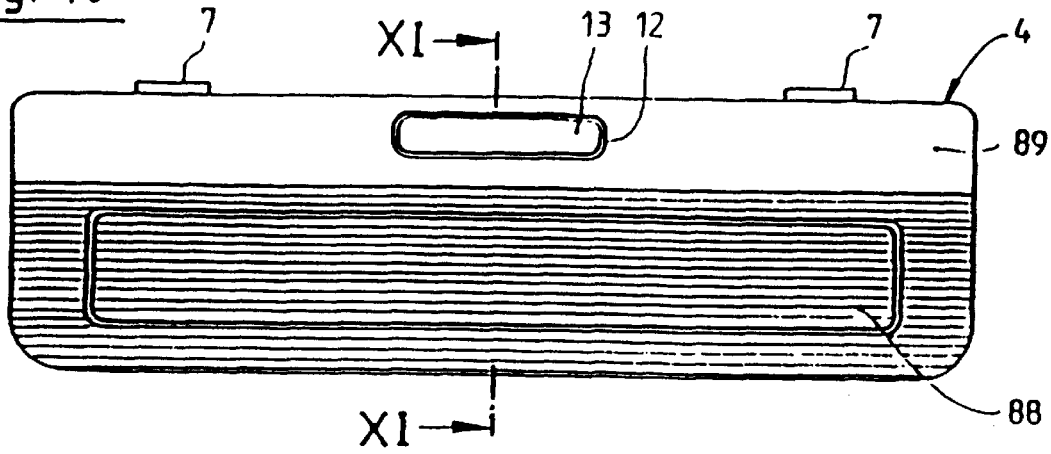
FIG. 10, a view of an automotive interior light with built-in electric restoring switch, and FIG. 11, a section through the automotive interior light relative to FIG. 10, in the direction of arrow XI—XI.
Figure 11:
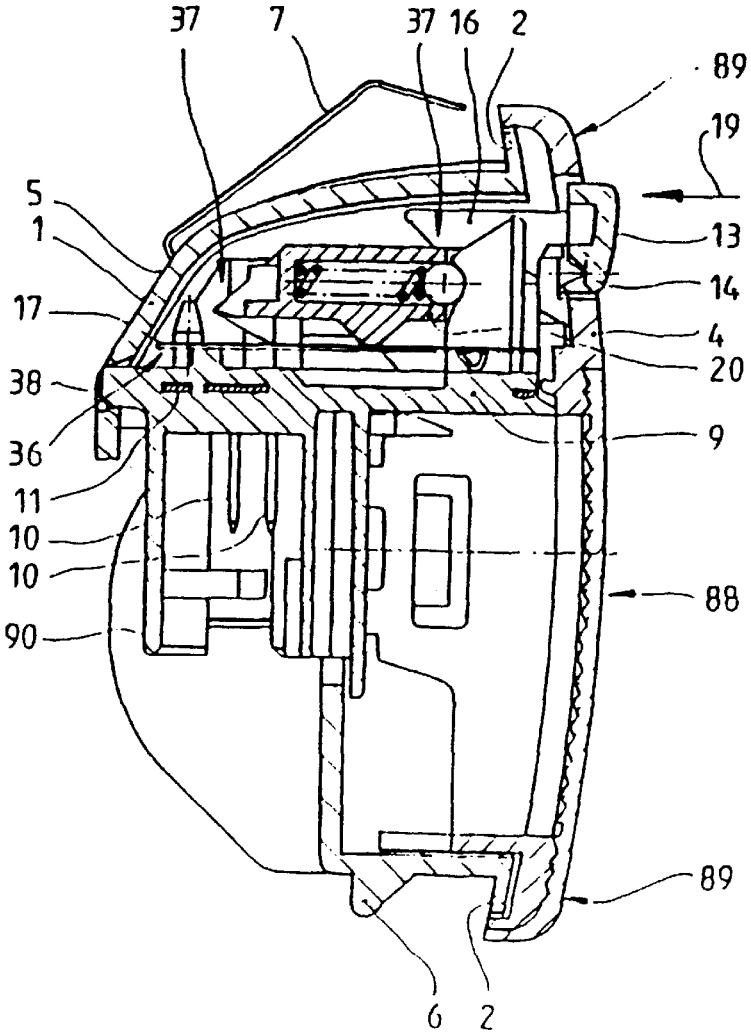

FIG. 10 and 11 show an automotive interior light in which the electric restoring switch is used. To the extent possible, same descriptions and references have been assigned to the components. Said interior light consists of a housing 1 with a surrounding rim 2 overhung by cover 4. Cover 4 has a translucent area 88 and an opaque area 89 and was made by a two-color injection molding process. The cover contains a hole 12 out of which protrudes button 13. Said automotive interior light is fixed by means of snap seat 6 and snap spring 7 in its assembly opening. Base 9 is assembled in housing 1 and possesses a holding device 36 with contact spring 17 and, besides, the switching member mount 37 with switching member 20. Contained in the base are blanked strips 11, which are in contact with connectors 10. Said connectors 10 are surrounded by plug housing 90. Contained inside the automotive interior light, furthermore, are not illustrated bulbs beneath the translucent area 88. The bulb connections are made as well via blanked strips 11, which at specific points emerge out of base 9 and feature appropriate sockets for the bulbs. The electric restoring switch is thus an integral part of the automotive interior light, with housing 1, cover 4 and base 9 being part of the interior light. Cover 4 has both a translucent area 88, behind which the illuminating elements are contained, and a further, opaque area 89 that extends around the translucent area 88. Contained in said opaque area 89 is the hole 12 through which the button 13 protrudes outward.

What is claimed is:

1. A switch assembly having a self restoring mechanism comprising:

(a) a base;

(b) a rocker actuator for user contact therewith in a first direction and eccentrically pivoted on said base including certain engagement surfaces thereon and user moveable between and unactuated and actuated position;

(c) a stationary contact disposed on said base;

(d) a moveable contact spring blade having a contact surface thereon, said blade resiliently deflectable for opening and closing said moveable contact surface with respect to said stationary contact;

(e) a switching member disposed on said base and extending generally parallel to said first direction, said switching member including portions having pivot surfaces thereon;

(f) said switching member, wherein said switching member has an end thereof, distal said pivot surfaces, pivoted on said base, said switching member including a cam surface contacting said moveable blade; and, (g) means disposed on said base defining a detent surface and resilient means on said switching member cooperating with said detent surface for detenting said rocker actuator in the unactuated position.

2. The switch defined in claim 1, wherein said means disposed on said base includes a ramp surface for increasing the user force required for movement of said rocker actuator.

3. The switch defined in claim 1, wherein said certain engagement surfaces of said rocker actuator includes a slot and said switching member pivot surfaces includes projections slidably engaging said slot.

4. The switch defined in claim 1, wherein said contact blade includes a snap acting element.

5. The switch defined in claim 1, wherein said base includes locating surfaces and said contact blade has location portions thereof configured to register against said locating surfaces for automatically positioning said contact blade on said base during assembly.

6. The switch defined in claim 5, wherein said locating surface comprises a bevel and a projection and said locating portions comprise an aperture received over said projection and a chamfer registered against said bevel.

7. The switch defined in claim 1, wherein said base includes a shell and a cover received over said shell with said rocker actuator pivoted on said cover.

8. The switch defined in claim 7, wherein said rocker actuator includes snap-locking lugs engaging said cover in arcuate sliding engagement.

9. The switch defined in claim 1, wherein said base includes a shell and a cover thereover, with said rocker actuator pivoted on said cover; and, said cover includes a translucent area and a cut-out with said rocker actuator extending therethrough.

* * * * *